US007124517B2

(12) United States Patent
Giraldo

(10) Patent No.: US 7,124,517 B2
(45) Date of Patent: Oct. 24, 2006

(54) **PROCESS FOR DRYING AND IMMUNIZING *GUADUA* AND FURNACE FOR CARRYING OUT THE PROCESS**

(75) Inventor: Alba Maria Mendoza Giraldo, Quindio (CO)

(73) Assignee: Maderas Y, Guaduas Ltda., Quindio (CO)

( * ) Notice: Subject to any disclaimer, the term of this patent is extended or adjusted under 35 U.S.C. 154(b) by 3 days.

(21) Appl. No.: 10/978,359

(22) Filed: Nov. 2, 2004

(65) Prior Publication Data

US 2006/0090365 A1 May 4, 2006

(51) Int. Cl.
*F26B 3/00* (2006.01)
*F26B 25/06* (2006.01)

(52) U.S. Cl. ..... 34/443; 34/201

(58) Field of Classification Search ..... 34/343, 34/396, 443, 539, 201, 86; 110/224, 225
See application file for complete search history.

(56) References Cited

U.S. PATENT DOCUMENTS 715,070 A * 12/1902 Hiorth ..... 34/86
4,531,304 A * 7/1985 Wauhop et al. ..... 34/391
5,351,416 A * 10/1994 Witkin ..... 34/79

* cited by examiner

*Primary Examiner*—Kenneth Rinehart
(74) *Attorney, Agent, or Firm*—Dennison, Schultz & MacDonald

(57) ABSTRACT

One is a process to dry and to immunize *guadua* twigs based upon the recirculation of smoke within a furnace provided this one with a coil that provides vaporized water to conform a humid atmosphere in a temperature of between the 30 and 50° c.

The furnace goes equally provided with air nozzles by pressure in the home and a recollection system of piro log (piroleñoso) acid of the drying, as well as parallel grills in the furnace to vertically align *guadua* twigs during the drying.

12 Claims, 4 Drawing Sheets

Fig. 1
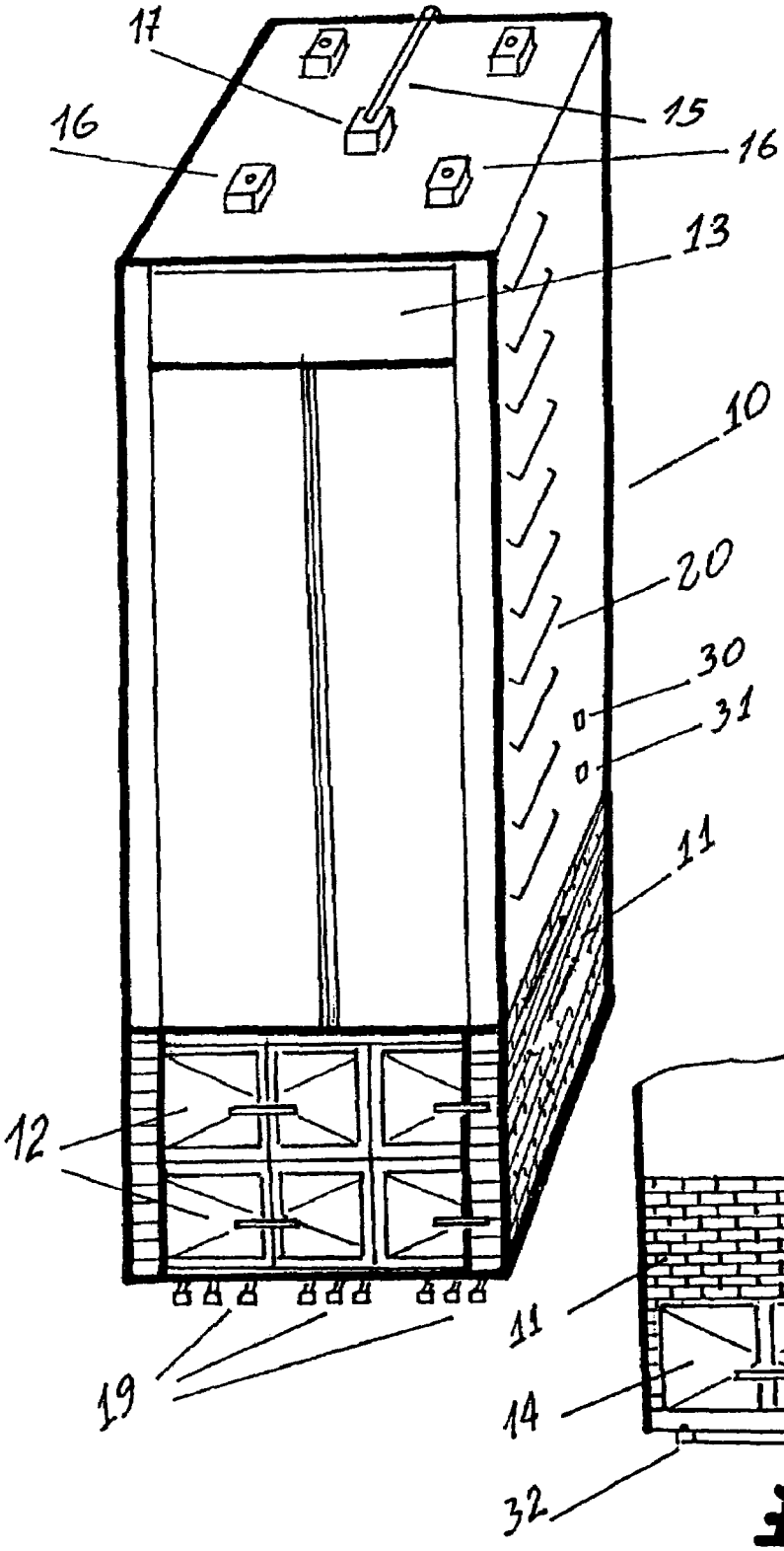
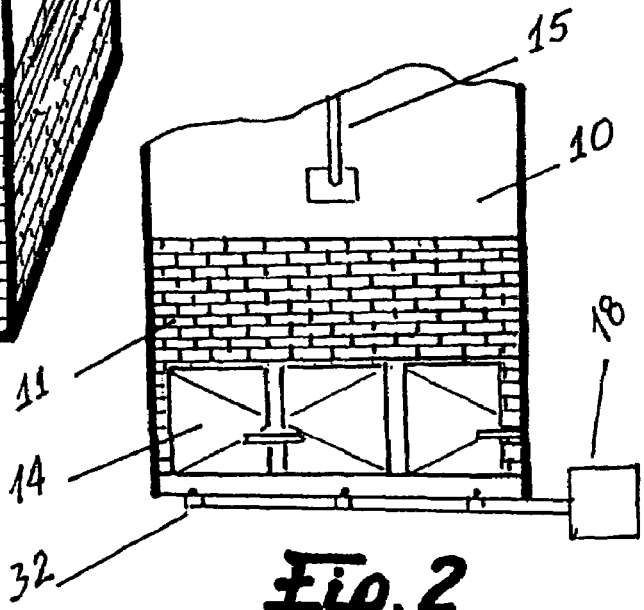
Fig. 2

PROCESS FOR DRYING AND IMMUNIZING *GUADUA* AND FURNACE FOR CARRYING OUT THE PROCESS

BACKGROUND OF THE INVENTION

The present invention is related to a procedure for the *guadua* twig drying, by means of smoke and consequently of the furnace or apparatus of special design for the development of this process.

*Guadua* (*bambusa guadua* or *guadua angustifolia*) is a vegetal species of the center of Colombia (coffee axis) that grows between the 700 and 2,000 meters of height in fertile grounds, harvesting between the 4 and 7 years of age for aims of construction of urban and rural house, and other works like bridges, stalls, sheds, coffee improvers, cabins, furniture and craftsmanship.

The *guadua* in its stem or fibrous cane is an element of good tensile strength compression and flexion. It is used in diameters of between 8 and 12 centimeters and in lengths of 3, 4, 5, and 6 meters specially.

SUMMARY OF THE INVENTION

The objective of the invention is to provide a system or procedure of immunized and drying of the *guadua* by smoke. Known in the technique of wood they are the processes of immunized and dried by immersion, by pressure (bousherinne) by injection and emptiness The smoke process which we propose in our process of invention, presents/displays advantages as increase in the density of fibers and its resistance in external efforts, it does not contaminate, and it reduces to a large extent the possible cracking of the *guadua*.

An objective of the invention is to provide an apparatus or furnace designed for this one aim, in agreement it will be described soon, and that sets out like novel element in its physical structure for the effects of the present invention, and according to the attached figures that relate the process and apparatus.

BRIEF DESCRIPTION OF THE DRAWINGS

The furnace is illustrated according to the following figures:

FIG. 1: it is a lateral of the furnace or apparatus of drying and immunized frontal vista.

FIG. 2: it is a vista of the posterior front of the apparatus or furnace.

DESCRIPTION OF THE PREFERRED EMBODIMENTS

Figure 3:
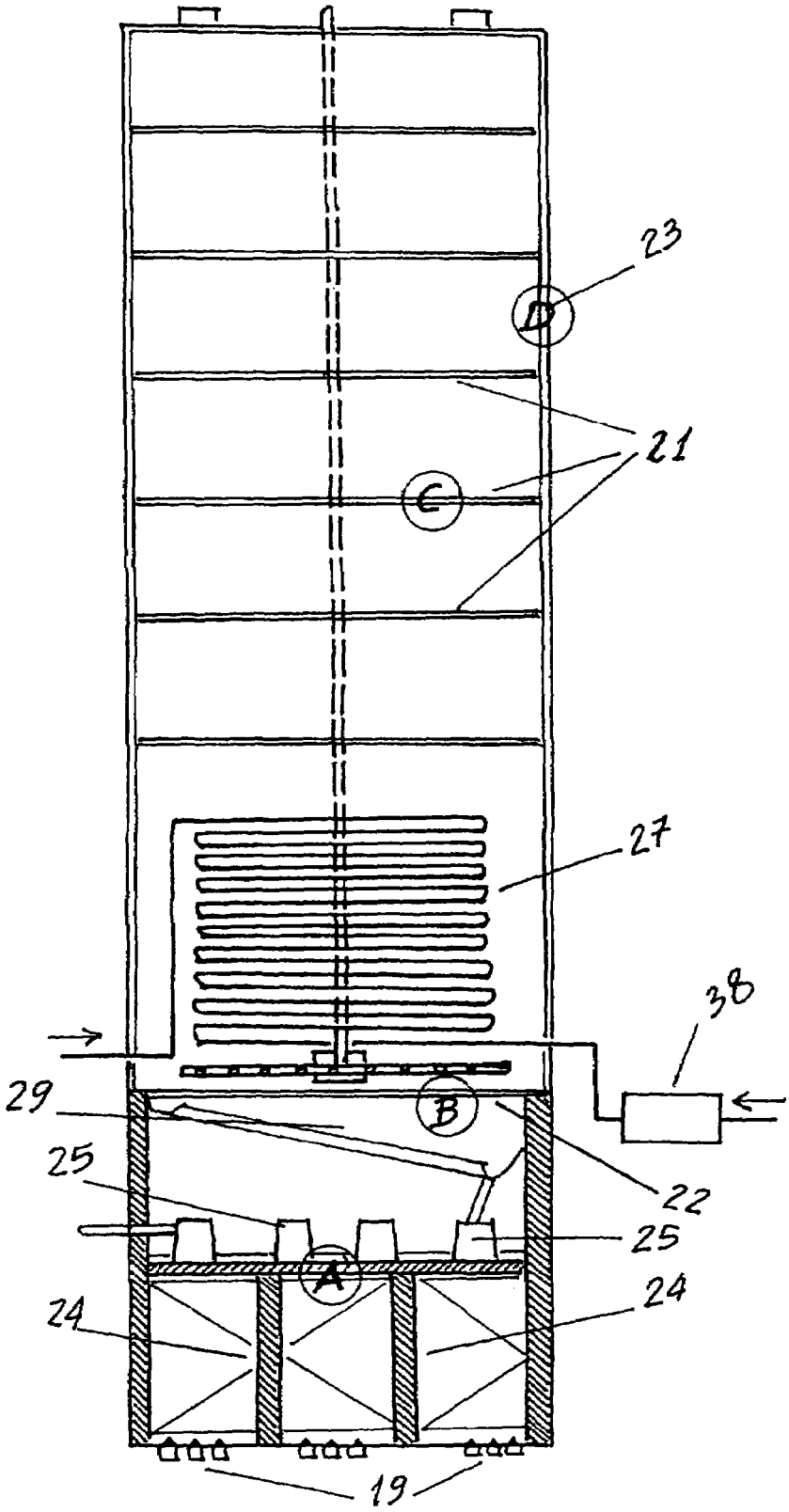
FIG. 3: it is a vista of the cut or inner vista of the furnace

The apparatus of drying and immunization of the *guadua* is characterized by a prismatic construction 10 on a refractory brick base 11 and a panel of frontal doors 12 to open and to close the combustion home, as much in the later front is had another game of homologous doors 14, a camera 13 to inner circulation of the drying smoke, and a duct 15 for the recirculation of said smoke through a turbine 17 in the ceiling of the furnace and valves of escape 16 located in the ceiling. In the base of the furnace, to the floor, and in the later flat an air turbine goes 18 that sends air by nozzles 28 to the interior of the home through valves 32. Auxiliary stairs 20 allow inspecting the valves of the ceiling.

Figure 5:
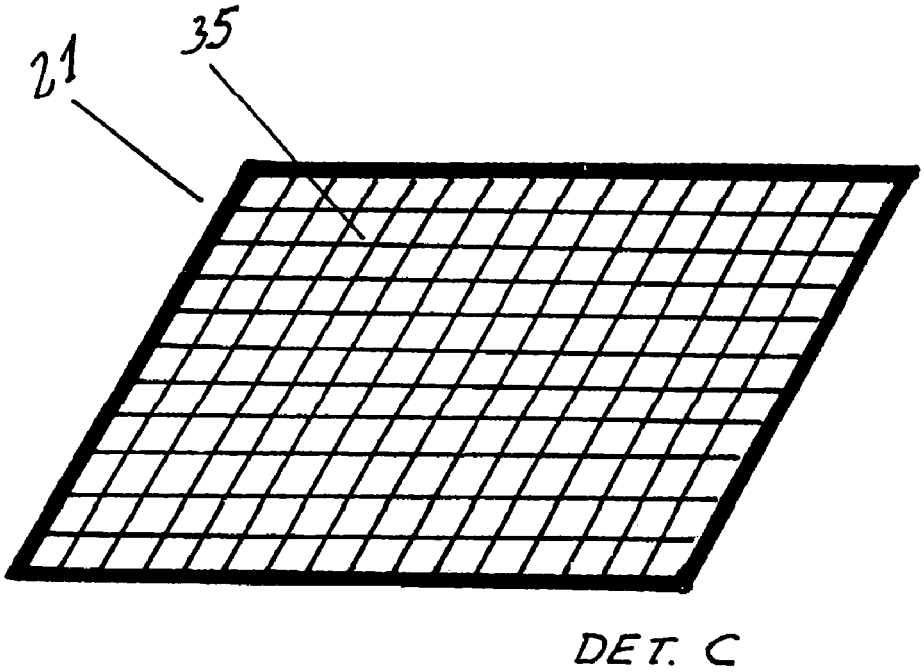
FIG. 5: it is one of the grills to align raised twigs of *guadua* within the furnace
Figure 6:
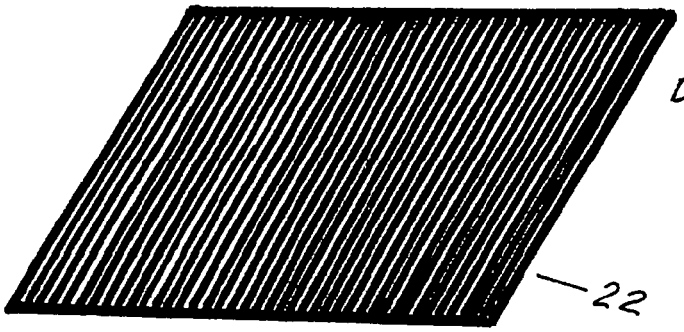
FIG. 6: it is a grill of the home of the furnace.

The interior of the furnace (FIG. 2) according to the shown longitudinal section, presents/displays grills 21 stepped parallel bars (FIG. 5) with which vertically align the twigs or canes of *guadua*, with base in the cross-linking or grating 35 of about 10 cms of Separation between each grid. Each grill has an exterior metallic frame (detailed *c*).

Figure 4:
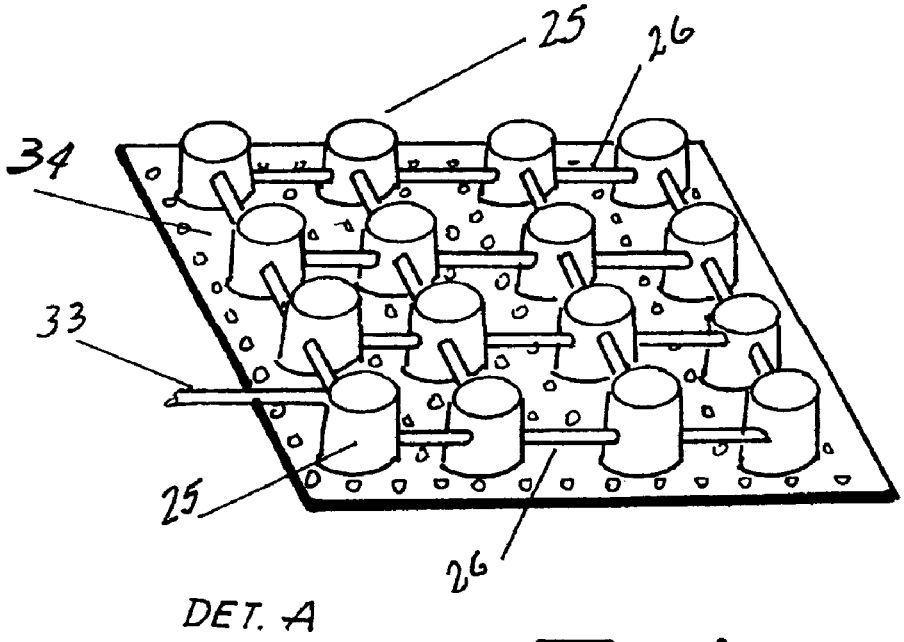
FIG. 4: it is a detail of elements of the home of the furnace that collect piro log (piroleñoso) acid.

Also, a grill 22 goes (figure—detail *b*) that receives ashes and remainders of the drying of the *guadua*, and on the homes of the incomplete combustion locates a disposition (6 FIG. 4—detail *a*) of collection glasses of piro log (piroleñoso) acid 25, effect of the drying, which is collected by gravity through collection channels 29 of the remainder and this one is evacuated by a overflow conduit 33.

These collection glasses 25 go communicated by a copper pipe 26 for this piro log (piroleñoso) acid, and the set is based on a steel sheet 34 which has perforations on its superfice.

Internally the furnace has a coil 27 with a cold water provision through a pump 38. A thermostat 30 and a thermometer 31 control the heat flow to the interior of the furnace for the drying.

Figure 7:
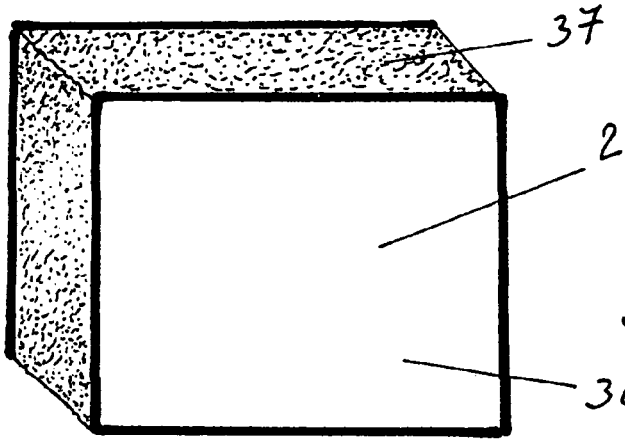
FIG. 7: it is a detail of the walls of the furnace.

The furnace has coating walls 23 (FIG. 7—detail *d*), composed of zinc sheets 36 that lock up a fiber glass isolation 37.

Figure 8:
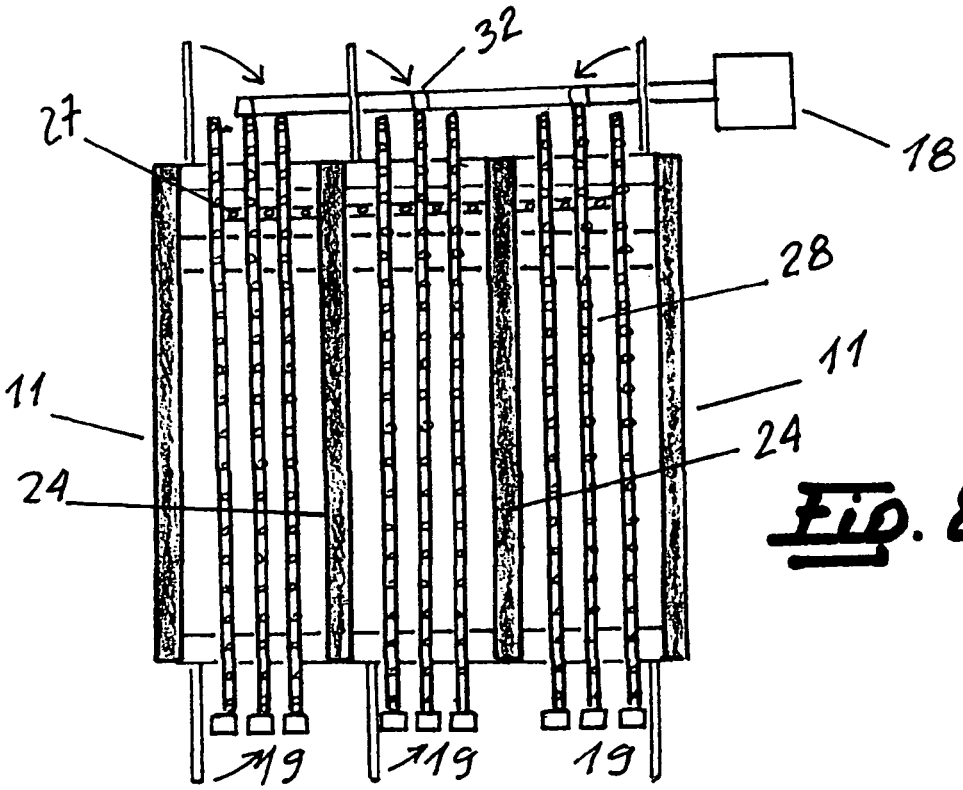
FIG. 8: it is a detail in plant of the home of the furnace with its insolated system.

In the home (FIG. 8) of incomplete combustion a turbine 18 that provides air to a game of perforated nozzles 28 arranged in three lines to the side and inner side of separating partitions 24 in the same home, and valves 19 in the exterior of the nozzles, homologous of a game of valves 32 for the admission of the air from the turbine.

These separating partitions 24 are made out of modular plates and perforated sheet. The conduit 15 for circulation of the smoke operates by a suction system that sends the smoke to other perforated conduits for its drying diffusion. The coil 27 has an exit of water to a pit, from which the pump takes the incoming water to the coil.

The home of the furnace (it inferior bases) is fed with organic combustible, (slack of rice, slack of coffee, wood and *guadua*) loading this fuel to the perforated sheet 34 that supports the collection glasses 25.

The process of drying and immunization of the *guadua* is based on a thermal cycle of controlled humidity and heat.

The *guadua* pieces are loaded in the furnace on vertical guard through grills 21 of alignment of twigs. In the inner part twigs of up to 4 meters are placed, and in aside superior those of 5 meters, of equal way with the pieces of 3 meters down, and 6 meters above and also those of 9 meters that cover the total capacity of the furnace.

Loaded the furnace and the homes with the mentioned fuel, its combustion through a blowpipe to gas begins.

The temperature is increased 10° C. every 24 hours gradually, by means of control of outer thermometer and with the gradual fuel ignition in each compartment of the home. The smoke generated by this one incomplete combustion and ascending temperature gradually of the water in the coil generates a humid atmosphere in the inner of the furnace that favors the drying and immunized of the *guaduas*.

The process in itself requires about four weeks which generates a water provision to the coil every 5 days. This produces a variation of the temperature between 30 and 40° C. in be beginning, and between 40 and 50° C. in the end, with a high initial humidity and low in the end.

The end of the fourth week it is hope that the furnace is dull with a balance of temperature between the outside and interior of the furnace.

The furnace is evacuated of the dry cuaguas in the end and its interior is cleaned to initiate a new cycle.

The process of immunized drying and of *guadua* with base in smoke allows advantages on the product, reflected in its absence of cracks, greater density, novel pigmentation, more resistant product, humidity of less of 15%, immunization against fungus and insects, minor drying time, and nonpolluting process for the non to use of chemical elements.

The process allows to control the temperature of the drying and controls the circulation of the smoke to the interior of the load to dry.

The apparatus or furnace is constructed with metallic conventional materials, sheets, flows, rods, plates, etc., as well as the pipes that can go in copper (communication glasses), galvanized (for the coil) and of perforated steel (for the ventilation nozzles in the home).

The invention claimed is:

1. A process for drying and immunizing *guadua* twigs, comprising the steps of:

loading vegetable organic fuel in a furnace;

placing *guadua* twigs in an upright position within the furnace;

placing water in an internal coil of the furnace;

igniting the fuel, and increasing temperature in the furnace by 10° C. each 24 hours until the temperature reaches a drying temperature between 30 and 50° C.;

provide a final humidity in the furnace controlled to 15%; and maintaining the drying temperature and humidity in the furnace for a period of four weeks, turning the furnace off, and removing dried and immunized *guadua* twigs from the furnace.

2. Process according to the claim 1, wherein the vegetal organic fuel, is selected from the group consisting of wood, sawdust, or slack of coffee and/or rice.

3. Process according to the claim 1, wherein the water in the coil evaporates creating in the furnace a humidity not more than 15%.

4. Process according to the claim 1, wherein by effect of the drying of the *guadua*, a remainder of piro log (pirolenoso) acid is collected within the furnace.

5. Process according to claim 1, comprising the steps of maintaining during an initial three weeks of drying a temperature between 30 and 40° C. and in a final week of drying a temperature between 40 and 50° C.

6. Process according to claim 1, wherein the evaporation of water in the coil provides a high initial humidity which is reduced to a final humidity of 15%.

7. Furnace for drying and immunizing of *guadua* twigs, comprising:

an internal volume for circulation of smoke;

a hearth for incomplete combustion;

a duct for recirculation of the smoke;

a coil for circulation of water for evaporation as means for maintaining humidity within the furnace;

superposed parallel grills for aligning *guadua* twigs vertically within the furnace;

a base support of glasses communicated to each other receiving distilled *guadua* product;

nozzles providing air to the combustion hearth, and an air turbine providing air to the nozzles;

a pump for providing water to the coil;

lateral insulating walls of the furnace; and a support base of refractory bricks.

8. Furnace according to claim 7, wherein the grills comprise metallic frame grids with an internal area drawn into a square grating to allow vertical alignment of the *guadua* twigs.

9. Furnace according to claim 7, wherein the supporting base of the communicating glasses contains an array of containers communicating with each other by a pipe that maintains a filling level, with an overflow pipe, these glasses receiving prio log (pirolenoso) liquid substance during the drying of the *guadua* twigs.

10. Furnace according to claim 9, wherein the communicating glasses are supported on a perforated metallic sheet.

11. Furnace according to claim 7, wherein the base of hearth of incomplete combustion comprises and array of compartments separated by partitions between which there is a row nozzles to provide combustion air.

12. Furnace according to the claim 7, wherein the lateral insulating walls comprise zinc and fiber glass.

* * * * *